US009335083B2

(12) United States Patent
Tafoya et al.

(10) Patent No.: US 9,335,083 B2
(45) Date of Patent: May 10, 2016

(54) MOVABLE ICE BIN GUARD

(75) Inventors: Cory Jerome Tafoya, Louisville, KY (US); Kyle Pfeffenberger, Celina, OH (US); Matthew Keith Sease, Charlestown, IN (US); Barry Waddilove, Hertfordshire (GB); Mark Wayne Wilson, Simpsonville, KY (US)

(73) Assignee: General Electric Company, Schenectady, NY (US)

( * ) Notice: Subject to any disclaimer, the term of this patent is extended or adjusted under 35 U.S.C. 154(b) by 723 days.

(21) Appl. No.: 12/825,427

(22) Filed: Jun. 29, 2010

(65) Prior Publication Data

US 2011/0314860 A1 Dec. 29, 2011

(51) Int. Cl.
*F25C 5/18* (2006.01)
*F25D 25/02* (2006.01)

(52) U.S. Cl.
CPC ..... *F25C 5/182* (2013.01); *F25C 2500/08* (2013.01); *F25D 25/025* (2013.01)

(58) Field of Classification Search
CPC ..... F25D 3/02; F25D 3/06; F25D 2303/081; F25D 25/025; F25C 5/007; F25C 5/182
USPC ..... 62/459, 344
See application file for complete search history.

(56) References Cited

U.S. PATENT DOCUMENTS

| | | | | |
|---|---|---|---|---|
| 3,146,601 | A * | 9/1964 | Gould | 62/3.6 |
| 3,398,552 | A * | 8/1968 | Pietrzak | 62/320 |
| 4,186,978 | A * | 2/1980 | Thomson | 312/321.5 |
| 4,269,039 | A * | 5/1981 | Baker | 62/344 |
| 4,333,588 | A * | 6/1982 | Schreck et al. | 222/164 |
| 6,484,529 | B2 * | 11/2002 | Dasher et al. | 62/344 |
| 2005/0241329 | A1 * | 11/2005 | Castrellon et al. | 62/340 |
| 2007/0245762 | A1 * | 10/2007 | Maglinger et al. | 62/344 |

* cited by examiner

*Primary Examiner* — Marc Norman
*Assistant Examiner* — David Teitelbaum
(74) *Attorney, Agent, or Firm* — Dority & Manning, P.A.

(57) ABSTRACT

A pivotable guard includes a guard surface configured to be mounted to a bin such that the guard surface is pivotable about an axis; and the bin including at least one side wall and a rear wall. The guard surface is configured to pivot between a lowered position relative to the bin and a raised position relative to the bin higher than the lowered position.

15 Claims, 7 Drawing Sheets

MOVABLE ICE BIN GUARD

BACKGROUND OF THE INVENTION

The present disclosure generally relates to a movable guard for an ice bin, and more particularly to a shallow tray that is capable of pivoting upward to prevent ice from spilling over the back of the bin while opening or closing a freezer drawer.

Refrigerator icemakers create and dispense ice into a freezer compartment of the refrigerator. The freezer compartment can contain a dedicated ice bin for containing the dispensed ice and separating ice storage from the remainder of the freezer compartment. Ice bins may have an open top for convenient access to ice by a consumer and have front, rear and side walls to prevent spillage. To accommodate the ice maker, however, conventional ice bins may have relatively shorter rear wall and side wall portions, which may allow ice to spill out of the bin into the main freezer compartment more easily during bin movement or ice retrieval by the consumer. Compounding this problem is that ice spilled from the bin is more difficult to retrieve and clear from the compartment and may become lodged in the rear of the compartment, preventing the compartment from being fully closed and thereby preventing closure of the freezer itself. For refrigerators having drawer-style freezer compartments, there is a risk of spillage every time the drawer is opened or closed by the consumer, especially if the drawer is moved and stopped rapidly such that ice pushes and piles up towards the back of the bin.

Accordingly, it would be desirable to provide a system that addresses at least some of the problems identified above.

BRIEF DESCRIPTION OF THE INVENTION

As described herein, the exemplary embodiments of the invention overcome one or more of the above or other disadvantages known in the art.

One aspect of the exemplary embodiments relates to a container comprising a bin comprising at least one side wall and a rear wall; and a pivotable guard comprising a guard surface mounted to the bin such that the guard surface is pivotable about an axis. The guard surface is configured to pivot between a lowered position relative to the bin and a raised position relative to the bin higher than the lowered position.

Another aspect of the exemplary embodiments relates to a refrigerator comprising a freezer compartment; a bin disposed in the freezer compartment and comprising at least one side wall and a rear wall; and a pivotable guard comprising a guard surface mounted to the bin such that the guard surface is pivotable about an axis. The guard surface is configured to pivot between a lowered position relative to the bin and a raised position relative to the bin higher than the lowered position.

Yet another aspect of the exemplary embodiments relates to a pivotable guard comprising a guard surface configured to be mounted to a bin comprising at least one side wall and a rear wall bin such that the guard surface is pivotable about an axis. The guard surface is configured to pivot between a lowered position relative to the bin and a raised position relative to the bin higher than the lowered position.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
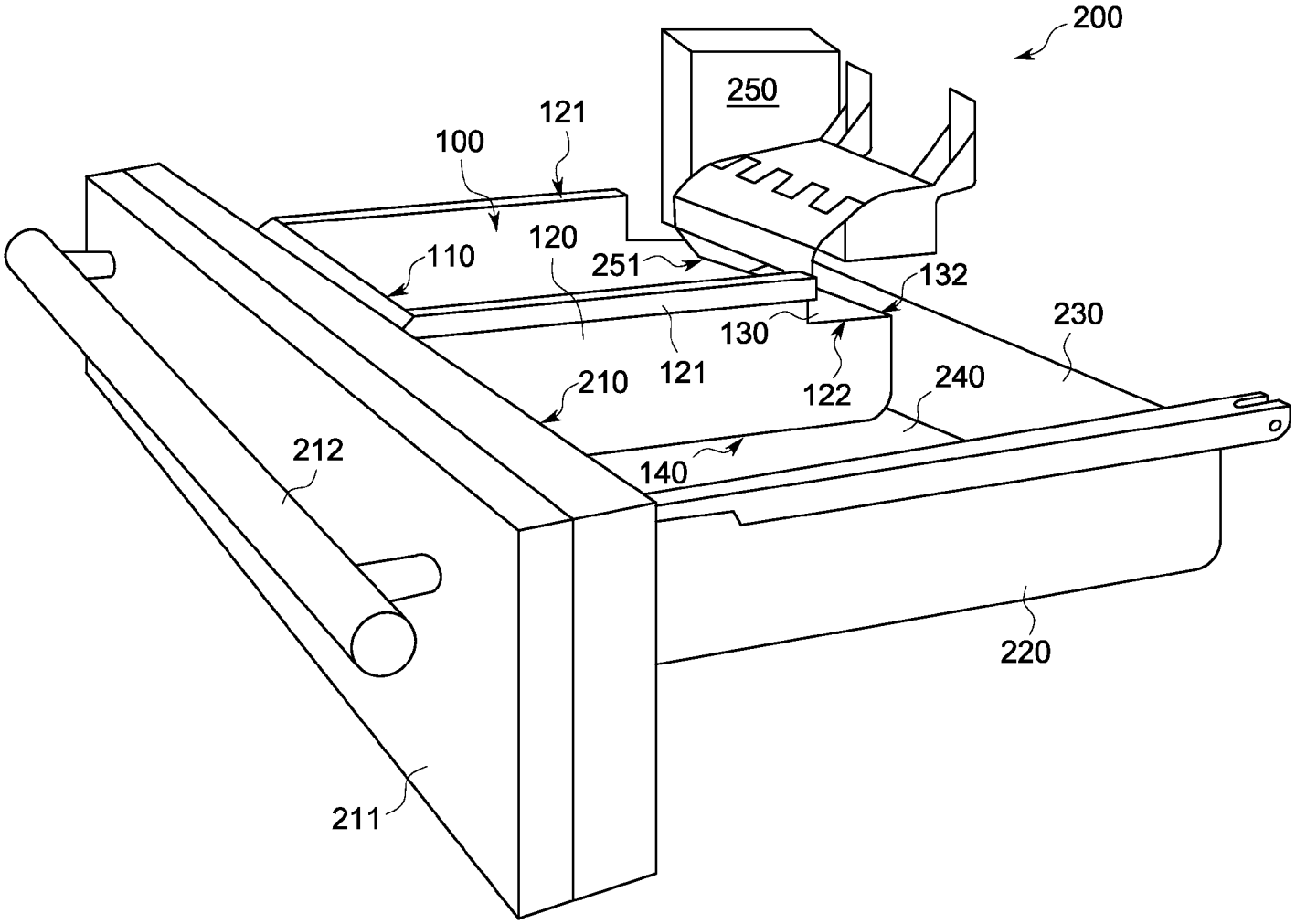
FIG. 1 PRIOR ART
FIG. 1 illustrates an ice bin according to the prior art.

FIG. 1 illustrates a perspective view of an ice bin 100 according to the prior art. The ice bin 100 is contained inside a refrigerator having an ice maker 250 having a sensor 251 and freezer drawer 200. The freezer drawer 200 comprises a front door 211 with a handle grip 212 and a front wall 210, side walls 220, rear wall 230 and bottom 240 defining an interior space. The drawer 200, in particular the rear wall 230, is configured to accommodate the ice maker 250 when the drawer 200 is closed. The ice bin 100 comprises a front wall 110, rear wall 130 having a rear edge 132 and rear side edge 122, side walls 120 having rails 121, and bottom 140 defining an interior space.

Because of the placement of the ice maker 250, the rear wall 130 and rear portions of the side walls 120 of the bin 100 must be lower than the lowest extending portion of the icemaker 250 to permit full closure of the drawer 200. One problem that this design creates is an increased risk of spills out of the back and sides of the ice bin 100 and drawer 200. Spillage out the back of the drawer 200 is especially problematic because the spilled ice can become jammed behind the drawer 200, preventing closure of the drawer 200. It can also be especially difficult to clear the area behind the drawer 200.

The ice maker 250 may include a sensor 251 that can detect an ice level in the bin 100 and keep the ice level below the height of rear wall 130. A higher front wall 110 and side walls 120 on the ice bin 100 can mitigate this spillage problem, but the momentum of opening and closing the drawer 200 can still cause ice to pile up against the rear wall 130, 230 and spill out over the back and side walls 120, 130, 220, 230 of the bin 100 and drawer 200, especially if the drawer 200 is opened and closed forcefully, as can be expected in a consumer appliance such as a refrigerator. Similarly, a consumer scooping ice from the bin 100 can also cause ice to displace and pile up against the rear of the bin 100, causing spillage.

Figure 2A:
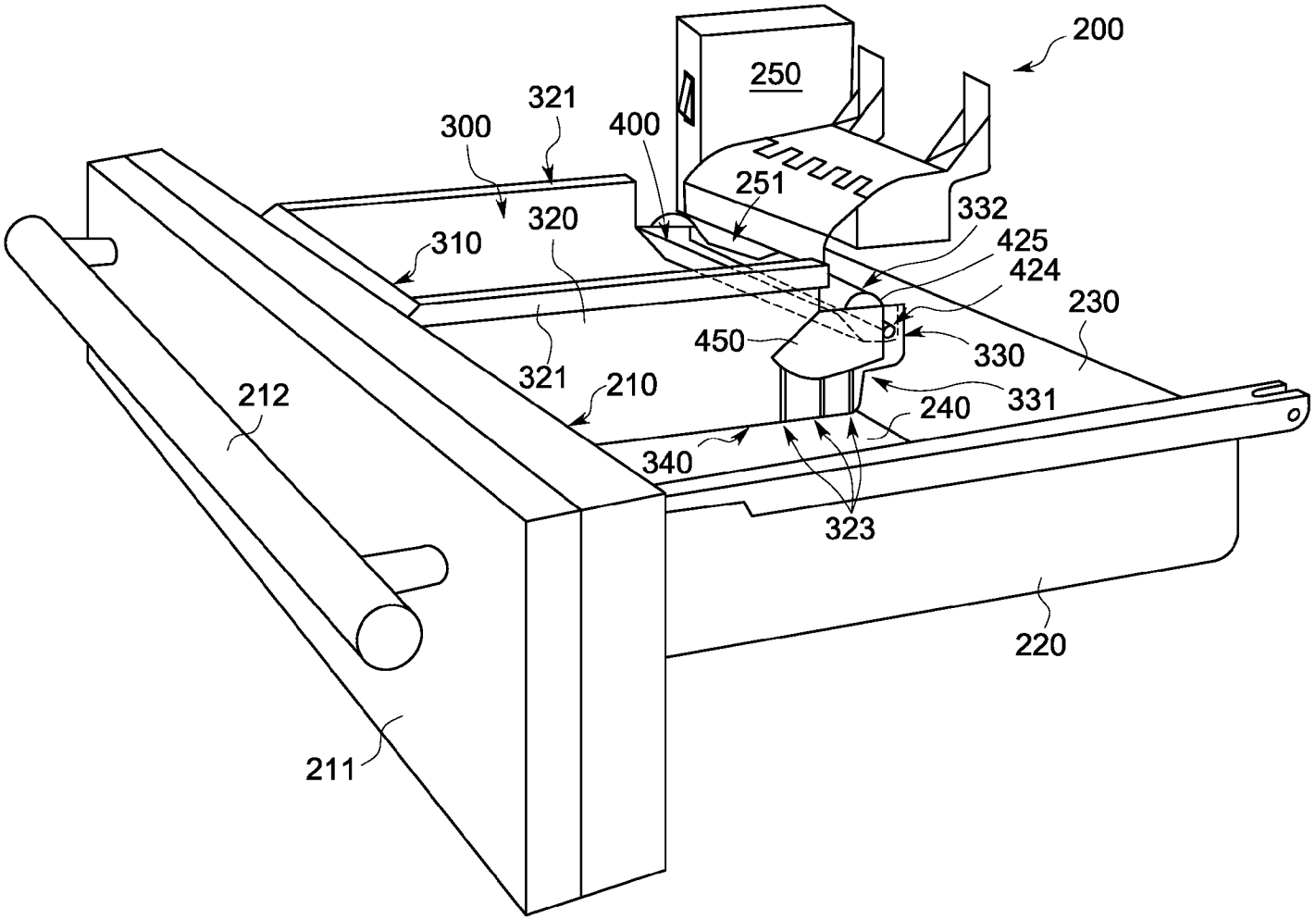
FIGS. 2*a* and 2*b* illustrate an ice bin and guard according to one embodiment.
Figure 2B:
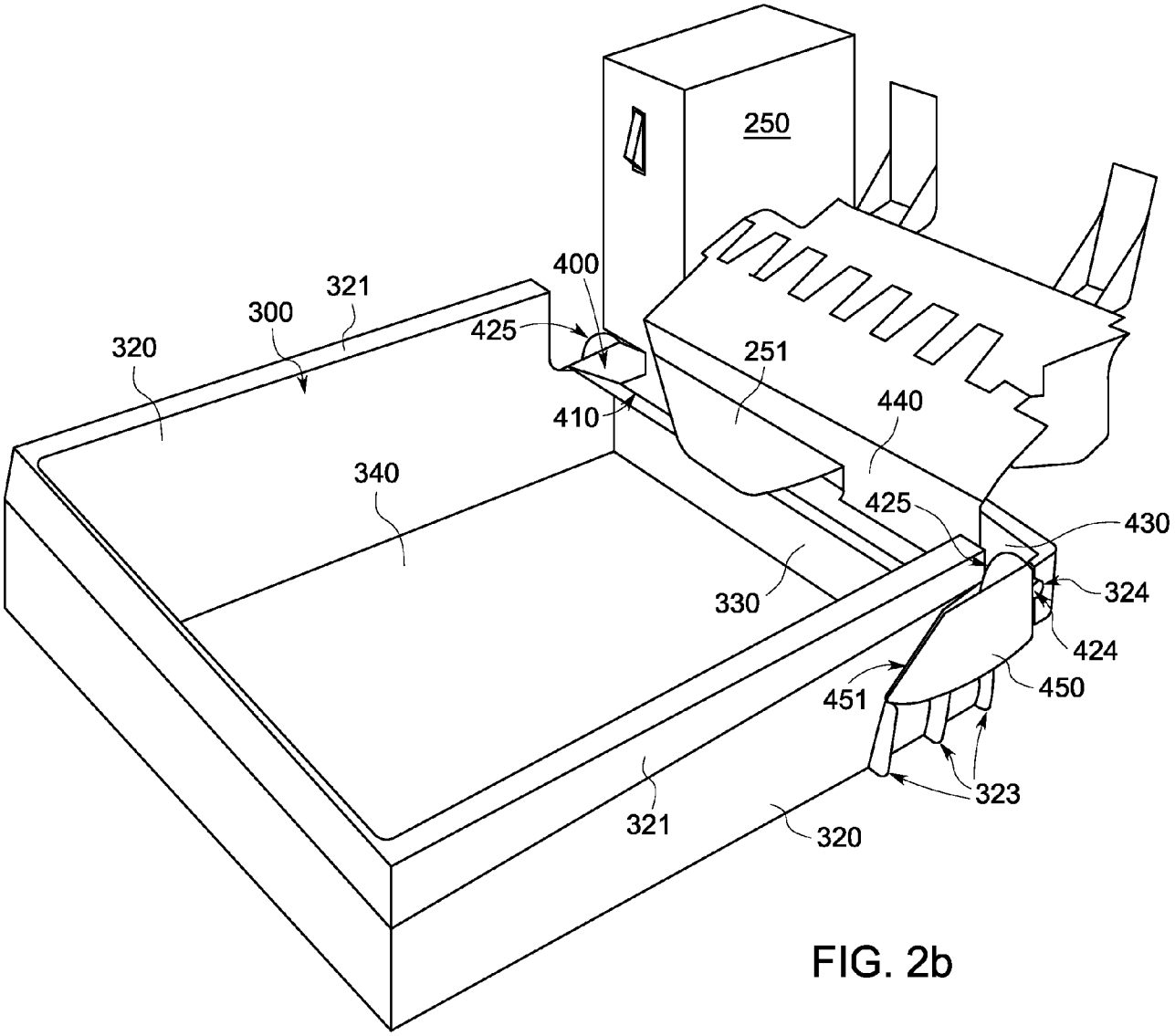

FIGS. 2*a* and 2*b* illustrate perspective views of an ice bin 300 and guard 400 according to an example embodiment of the invention. The ice bin 300 comprises a front wall 310, rear wall 330 having a contoured portion 331 and rear edge 332, side walls 320 and bottom 340 defining an interior space, rails 321 at the top edges of the side walls 320 for mounting the bin 300 on supports (not shown) of the drawer 200 and hinge slots 324 for forming a pivoting support for guard 400. The ice bin 300 may also comprise one or more ribs 323 on the side walls 320 for additional protection of guard tabs 450, described in detail below. The guard 400 comprises a number of guard surfaces, including a front wall 410, rear wall 430 and side walls 420 defining a tray, hinges 424 for mating with the hinge slots 324 of the bin 300 and for pivoting the guard about an axis, guide portions 425 for aiding closure of the guard 400, and tabs 450 for engaging the rails 321 when the guard 400 is in a raised position, thereby preventing the guard 400 from pivoting upwardly past the raised position and blocking ice from escaping around the side walls 320 of the bin 300.

Figure 3A:
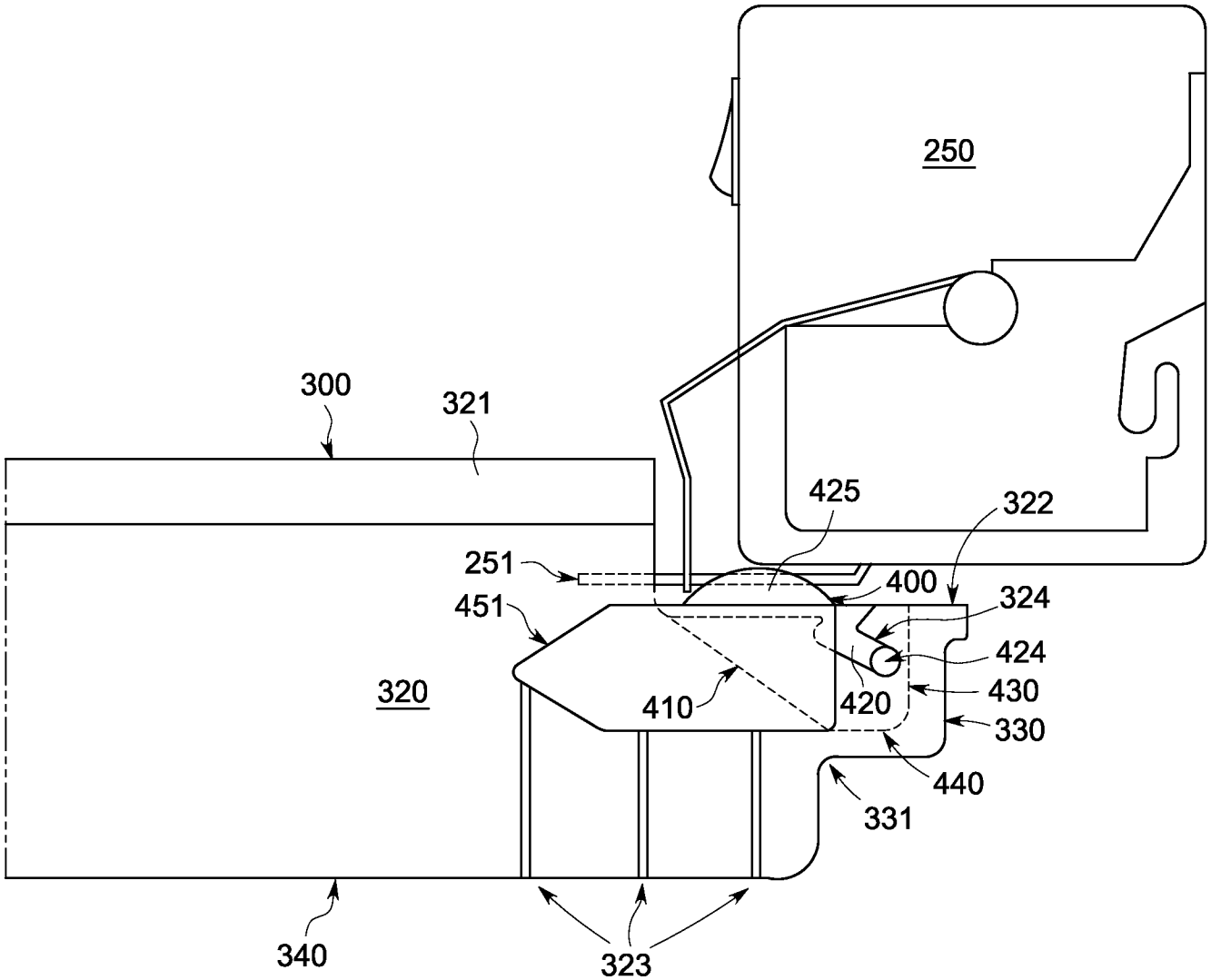
FIGS. 3*a*-3*c* illustrate a side view of the ice bin and guard of FIGS. 2*a* and 2*b* in operation.
Figure 3B:
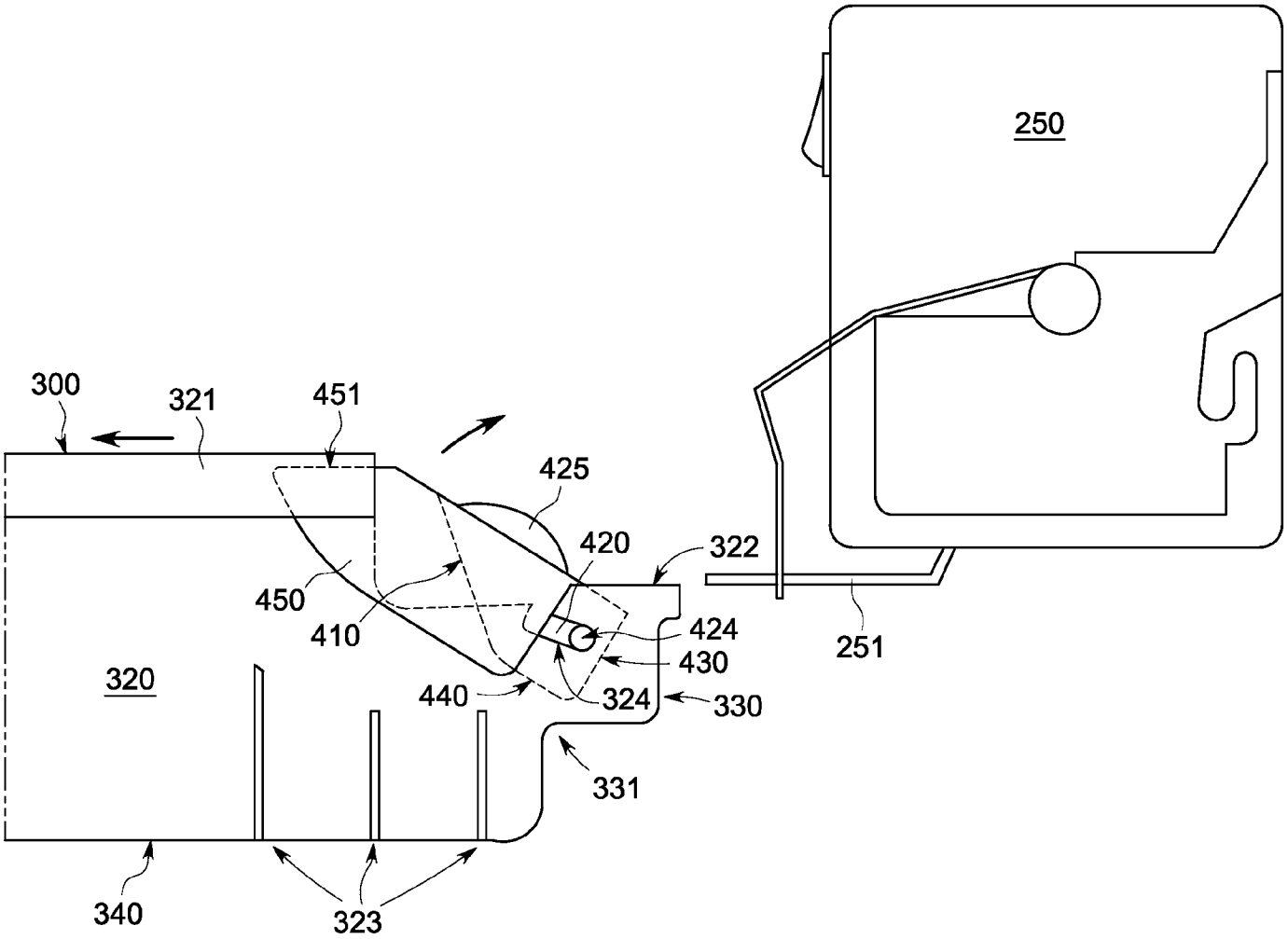
Figure 3C:
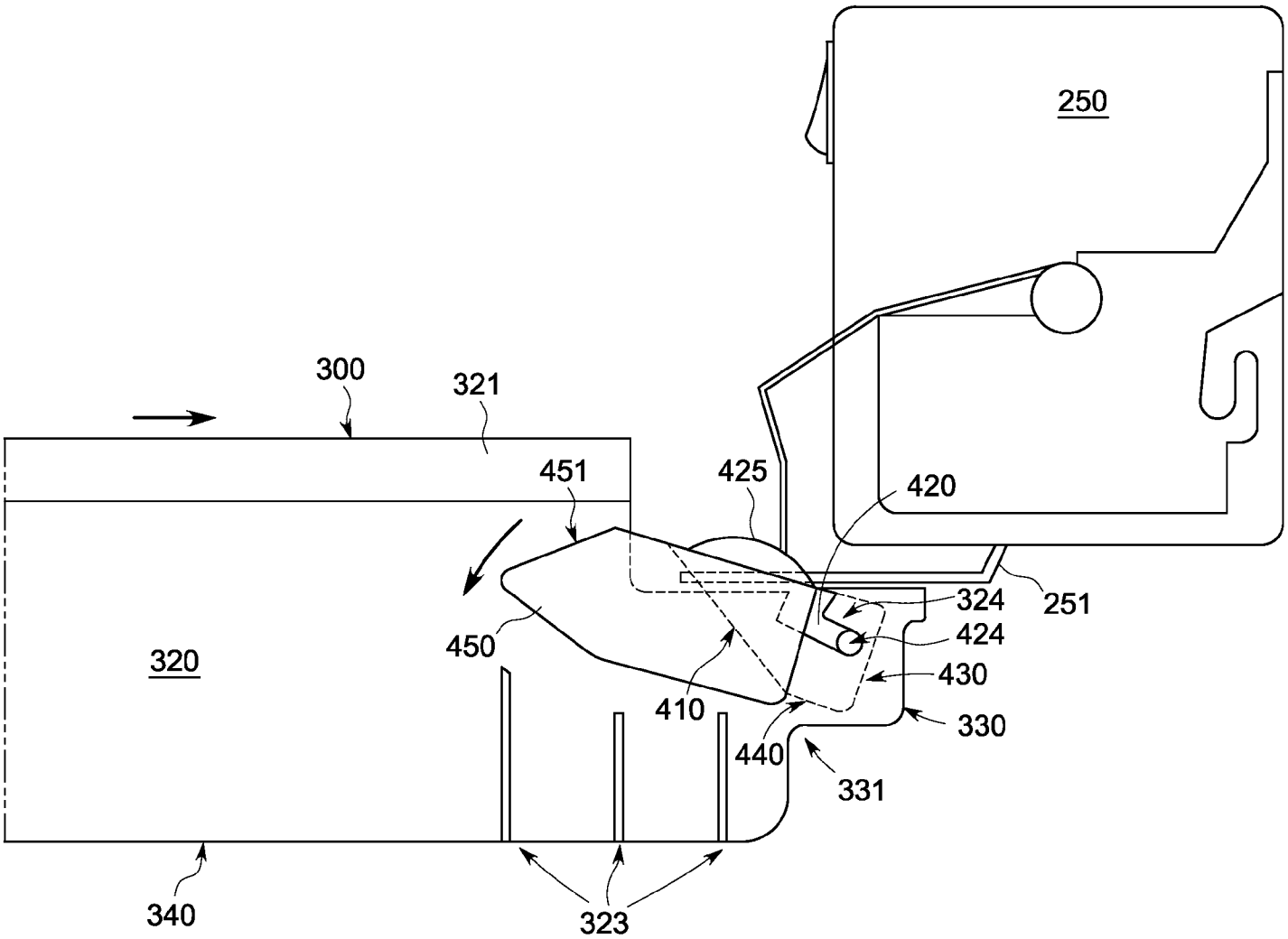

FIG. 3*a*-3*b* illustrate a side view of the embodiment shown by FIGS. 2*a*-2*b* above. FIG. 3*a* illustrates the bin 300 and guard 400 when the drawer 200 is closed. FIG. 3*b* illustrates the bin 300 and guard 400 when the drawer 200 has been opened and after the guard has been raised, for example, through movement of ice (not shown) pressing up against the guard. FIG. 3*c* illustrates the bin 300 and guard 400 as the drawer 200 is being returned to the closed position illustrated by FIG. 3*a*.

When force is applied to the front wall 410 of the guard 400 (as in FIG. 3*b*), such as from the movement of ice toward the rear wall 330 of the bin 300, the guard 400 rotates upwardly about the hinges 424, forming a raised barrier that blocks ice from escaping out the back and sides of the bin 300. This arrangement may be helpful in embodiments that employ a sensor 251 to prevent the ice maker 250 from filling the bin 300 past the height of the rear wall 330 because displacement of ice that raises the level of the ice past the height of the rear wall 330 will also apply horizontal force against the front wall 410 of the guard 400, thereby raising the guard 400 into a raised position as the ice is displaced, reducing or eliminating spillage.

Alternative embodiments may include lowering the rear wall 330 of the bin only, portions of the rear wall 330 having different geometries, and/or different portions of the side walls 320 in order to accommodate different ice makers 250 having different geometries.

Tabs 450 have a number of functions. First, when the guard 400 is rotated into a raised position, the tabs 450 raise to cover gaps between the higher portions of the side walls 320 and the raised front wall 410 and bottom 440 of the guard 400 that prevents ice from spilling over the back of the bin 330 and drawer 230, thereby preventing ice from spilling out the sides of the bin 300 as well. Second, the tabs 450 have edges 451 that engage the rails 321 when in the raised position, thereby preventing the guard 400 from rotating up and around, out of the raised position. The guard 400 may alternatively or supplementally engage another portion of the bin 300 preventing over-rotation and/or hinges 424 that are limited to a particular arc of rotation.

In some embodiments, one or more ribs 323 may be provided for protection of the tabs 450. These ribs 323 may be also be configured to abut portions of the guard 400, e.g., the tabs 450, when the guard 400 is in a lowered position. The ribs 323 may also allow the widest portion of the bin 300 to match a width of the widest portion of the guard 400, making it easier to fit the bin 300 in a drawer 200 having planar side walls 220.

The hinge 424 and hinge slot 324 arrangement has a number of advantages. First, unitary construction allows for simple, sturdy and inexpensive construction of the bin and guard. Second, the open slot 324 design allows the guard to be easily removed to clear jams and clean the guard 400 while the right angled portion of the slot 324 helps prevent the guard 400 from being accidental dislodged during operation. Alternative embodiments may include hinges that are not unitary with the bin 300 or guard 400, for example a straight rod, rivets or bolts. The pivoting connection is not biased in either direction in this example embodiment, but may be biased in alternative embodiments, as discussed in detail in subsequent paragraphs.

If the force of displaced ice or another force has raised the guard 400 into the raised position, portions of the icemaker 250 will force the guard 400 back into the lowered position as the drawer 200 is closed, forcing displaced ice back down and forward in the bin 300. In this embodiment, the guard 400 includes guides 425 that engage portions of the icemaker 250 in order to prevent contact between other parts of the guard 400 and icemaker 250, preventing damage to either component when the drawer 200 is being closed. Guides 425 may aid in providing more force for lowering the guard 400 when small amounts of ice are trapped between the bin 300 and guard 400, and may also help guide ice that spills over the front wall 410 of the guard into a tray formed from walls 410, 420, 430 and floor 440. In this embodiment, the guides 425 have an arcuate profile, but alternative embodiments may use guides having different geometries.

It should be understood that these example embodiments are not limiting. For example, the guard 400, e.g. tabs 450 and other elements, may comprise different shapes to correspond to different bin geometries and to cover rear and side gaps having different shapes. Tabs 450 may also be configured to increase or reduce a moment arm force about the hinge 424, for example by providing more or less material at a distal end of the tab 450 away from the hinge 424.

Another feature of the guard 400 of this example embodiment is that the walls 410, 420, 430 and floor 440 form a tray configured to catch ice that spills over the guard. In the example embodiment, the front wall 410 is provided at an angle such that the front wall 410 stops ice during compartment opening/closing, and such that ice slides down into the tray regardless of whether the guard 400 is in a raised or lowered position. In the example embodiment, the front wall 410 is fully vertical when the guard 400 is in a raised position. In the example embodiment, the rear wall 430 and floor 440 complement the rear wall 330 and contoured portion 331 of the bin 300 so that ice is less able to become trapped behind the guard 400 when the guard 400 is in a lowered position. In this example, the contoured portion 331 is shaped such that ice falls down away from that portion of the bin 300 when the guard 400 is raised, so that no ice becomes trapped when the guard 400 is lowered.

In the example embodiment, the guard 400 is not biased to rotate in any direction, except by gravity. In other embodiments, the guard 400 may be additionally biased, e.g., via a spring, toward a raised or lowered position. One reason for biasing the guard 400 into a raised position may be to automatically create a barrier whenever the drawer 200 is opened, relying on the ice maker 250 to push down on the guides 425 to move the guard 400 into a lowered position when closing the drawer 200. One reason for biasing the guard 400 into a lowered position may be to allow the guard 400 to be raised only when force is applied enough to displace a significant amount of ice. The hinge 424 may also be biased upwardly just enough to counteract the force of gravity. One reason for biasing the guard 400 upwardly sufficient to counteract gravity alone may be to allow the guard 400 to freely pivot between raised and lowered positions, responding only to the forces of displaced ice on the one hand, and the downward force of the icemaker 250 on the guides 425 on the other hand.

Figure 4:
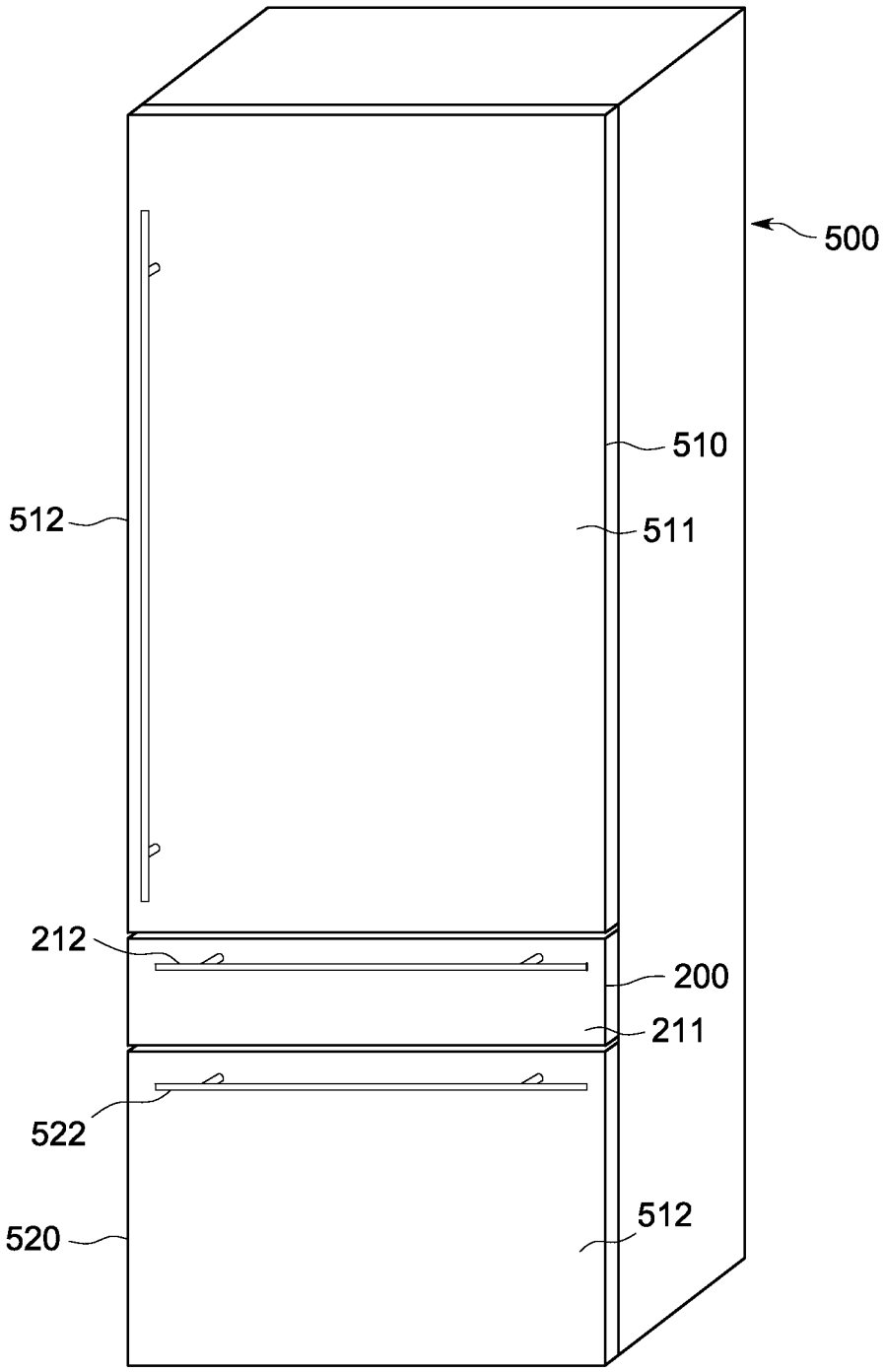
FIG. 4 illustrates a refrigerator having an ice bin and guard according to one embodiment.

FIG. 4 illustrates a refrigerator 500 having an ice bin and guard according to one embodiment. In addition to drawer 200, shown in other embodiments in greater detail, the refrigerator 500 may also have a refrigerator door 510 having a front wall 511 and handle 512, as well as a second freezer door 520 for a larger freezer storage compartment 520 having a front wall 512 and handle 522. Embodiments of the ice bin and guard may be incorporated into this or any other compatible refrigerator configuration.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A container, comprising:

a bin comprising a first side wall, a second side wall, a bottom wall, a front wall of a first height from the bottom wall connecting the first side wall to the second side wall, and a rear wall of a second height from the bottom wall lower than the first height connecting the first side wall to the second side wall, a rail positioned on the first side wall opposite the bottom wall: and a pivotable guard comprising:

a guard surface disposed between the front wall and the rear wall and pivotably mounted to the first side wall and the second side wall of the bin such that the guard surface is pivotable about an axis, wherein the guard surface is configured to pivot between a lowered position relative to the bin where the guard surface is disposed inside the bin and a raised position relative to the bin higher than the lowered position, and a first tab that abuts the rail when the guard surface is in the raised position such that the guard surface is prevented from rotating upward beyond the raised position, wherein in the lowered position, a top edge of the guard surface is at or below the second height, wherein in the raised position, the top edge of the guard surface is higher than the second height, and further comprising at least one guide portion connected to and extending upwardly from the pivotable guard, wherein the at least one guide portion is arranged to abut a portion of a refrigerator compartment when a refrigerator drawer containing the container is closed in the refrigerator compartment such that the portion of the refrigerator compartment causes the guard surface to move from the raised position to the lowered position as the refrigerator drawer is closed.

2. The container according to claim 1, wherein the first tab is disposed in a plane parallel to the first side wall such that the first tab forms a barrier adjacent to the first side wall when the guard surface is in the raised position.

3. The container according to claim 2, wherein the pivotable guard further comprises a second tab disposed in a plane parallel to the second side wall such that the second tab forms a barrier adjacent to the second side wall when the guard surface is in the raised position.

4. The container according to claim 2, wherein the first tab abuts a second portion of the bin which is connected to the first side wall when the guard surface is in the lowered position such that the guard surface is prevented from rotating downwards beyond the lowered position.

5. The container according to claim 4, wherein the second portion of the bin is at least one rib extending outward from an outer surface of the first side wall.

6. The container according to claim 1, further comprising a tray, the guard surface forming a front wall of the tray.

7. The container according to claim 1, wherein the guard surface is arranged such that the guard surface is at a first vertical angle when the guard surface is in the lowered position, and a second vertical angle when the guard surface is in the raised position, the second vertical angle being steeper than the first vertical angle.

8. The container according to claim 1, wherein the at least one guide portion is arcuate.

9. The container according to claim 1, wherein the portion of the refrigerator compartment is an icemaker.

10. A refrigerator, comprising:

a freezer compartment;

a bin disposed in the freezer compartment and comprising a first side wall, a second side wall, a bottom wall facing a ground surface, a front wall of a first height from the bottom wall connecting the first side wall to the second side wall, and a rear wall of a second height from the bottom wall lower than the first height connecting the first side wall to the second side wall, a rail positioned on the first side wall opposite the bottom wall: and a pivotable guard comprising:

a guard surface disposed between the front wall and the rear wall and pivotably mounted to a first portion of the first side wall and a first portion of the second side wall of the bin such that the guard surface is pivotable about an axis, wherein the guard surface is configured to pivot between a lowered position relative to the bin where the guard surface is disposed inside the bin and a raised position relative to the bin higher than the lowered position, and a first tab that abuts the rail when the guard surface is in the raised position such that the guard surface is prevented from rotating upward beyond the raised position, wherein in the lowered position, a top edge of the guard surface is at or below the second height, wherein in the raised position, the top edge of the guard surface is higher than the second height, and at least one guide portion connected to and extending upwardly from the pivotable guard, wherein the at least one guide portion is arranged to abut a portion of a refrigerator compartment when a refrigerator drawer containing the bin and the pivotable guard is closed into the refrigerator compartment such that the portion of the refrigerator compartment causes the guard surface to move from the raised position to the lowered position as the refrigerator drawer is closed.

11. The refrigerator according to claim 10, wherein the first tab is disposed in a plane parallel to the first side wall such that the first tab forms a barrier adjacent to the first side wall when the guard surface is in the raised position.

12. The refrigerator according to claim 11, wherein the pivotable guard further comprises a second tab disposed in a plane parallel to the second side wall such that the second tab forms a barrier adjacent to the second side wall when the guard surface is in the raised position.

13. The refrigerator according to claim 11, wherein the first tab abuts the first portion of the bin which is connected to the first side wall when the guard surface is in the lowered position such that the guard surface is prevented from rotating downwards beyond the lowered position.

14. The refrigerator according to claim 10, wherein the portion of the refrigerator compartment is an icemaker.

15. The container according to claim 1, wherein the guard surface is disposed adjacent to the rear wall.

* * * * *